US005199709A

United States Patent [19]

Lumpp, Jr. et al.

[11] Patent Number: 5,199,709

[45] Date of Patent: Apr. 6, 1993

[54] DICE AND METHOD FOR SELECTING LOTTERY NUMBERS

[76] Inventors: Raymond J. Lumpp, Jr.; Mary F. Lumpp, both of 1420 Grove St., NE., North Canton, Ohio 44721

[21] Appl. No.: 829,763

[22] Filed: Feb. 3, 1992

[51] Int. Cl.[5] ..... A63F 9/04

[52] U.S. Cl. ..... 273/146

[58] Field of Search ..... 273/146, 246

[56] References Cited

U.S. PATENT DOCUMENTS

| | | | |
|---|---|---|---|
| 604,401 | 5/1898 | Lang | 273/146 |
| 1,561,592 | 11/1925 | Bott, Jr. | 273/146 |
| 2,560,187 | 7/1951 | Post | 273/146 |
| 4,042,245 | 8/1977 | Zarour | 273/246 |
| 4,678,190 | 7/1987 | Dery | 273/146 |
| 4,874,175 | 10/1989 | Fischer | 273/146 |
| 4,989,874 | 2/1991 | Freitas | 273/146 |
| 5,013,040 | 5/1991 | Schiechl | 273/146 |
| 5,031,915 | 7/1991 | Sanditen | 273/146 |

*Primary Examiner*—Benjamin H. Layno
*Attorney, Agent, or Firm*—Michael Sand Co.

[57] ABSTRACT

An apparatus and method of selecting a set of integers from a larger, predetermined sequence of integers, whereby a multiplicity of dice equal in number to the number of integers in said predetermined sequence of integers is provided, with each die having a plurality of exterior faces with an integer of the predetermined sequence on only one face of each die. Moreover, at least a portion of the integer bearing face has one of a predetermined set of colors, such that each color is associated with a subset of integers from the predetermined sequence of integers, such that each subset is generated by reviewing the number of times each integer was chosen in a previous years lottery with those integers appearing most often having a first color, those integers appearing next most often having a second color, until finally the integer appearing least often is assigned a last color. The color appearing on the face of the die being the color associated with the subset of which the facing integer is a member. The above described dice are then shaken and rolled onto a flat surface. Thereafter, the number of dice equal in number to the set of integers from all of said dice with the integer bearing surface oriented in the preselected position, is selected by choosing those integers having the first priority color first, and completing the set with each subsequent priority color until the entire set of integers to be selected for the lottery is completed.

13 Claims, 3 Drawing Sheets

| | COLUMN 1 INTEGER | COLUMN 2 CHOSEN |
|---|---|---|
| COLOR 1 (GOLD) | 47 | 16 |
| | 44 | 15 |
| | 40 | 15 |
| | 1 | 15 |
| | 9 | 15 |
| COLOR 2 (SILVER) | 2 | 14 |
| | 46 | 14 |
| | 36 | 14 |
| | 26 | 14 |
| | 18 | 14 |
| | 13 | 14 |
| COLOR 3 (GREEN) | 6 | 13 |
| | 20 | 13 |
| | 21 | 13 |
| | 34 | 13 |
| | 29 | 13 |
| | 12 | 13 |
| COLOR 4 (BLUE) | 5 | 12 |
| | 37 | 12 |
| | 19 | 12 |
| | 14 | 11 |
| | 17 | 11 |
| | 38 | 11 |
| | 4 | 11 |

| | COLUMN 1 INTEGER | COLUMN 2 CHOSEN |
|---|---|---|
| COLOR 5 (RED) | 16 | 10 |
| | 24 | 10 |
| | 7 | 10 |
| | 22 | 10 |
| COLOR 6 (WHITE) | 45 | 9 |
| | 3 | 8 |
| | 11 | 8 |
| | 28 | 8 |
| | 42 | 8 |
| COLOR 7 (ORANGE) | 8 | 7 |
| | 10 | 7 |
| | 23 | 7 |
| | 19 | 6 |
| | 25 | 5 |
| | 30 | 5 |
| | 33 | 5 |
| | 41 | 5 |
| COLOR 8 (BLACK) | 15 | 4 |
| | 27 | 4 |
| | 32 | 4 |
| | 39 | 4 |
| | 31 | 3 |
| | 35 | 3 |

FIG-3

DICE AND METHOD FOR SELECTING LOTTERY NUMBERS

BACKGROUND OF THE INVENTION

1. Technical Field

The present invention relates in general to games of chance. More particularly, the invention relates to an apparatus and method for selecting a set of integers from a predetermined sequence of numbers based upon the frequency each integer was chosen in the previous years lottery.

2. Background Information

Many of our states have legalized state operated lotteries to satisfy the gaming instincts of its citizenry and to attempt to slow the periodic trips to large legal gambling centers such as Atlantic City. Generally, these lotteries provide a game in which a player selects a small set of numbers or integers from a predetermined larger sequence of numbers. For example, in the lottery game of one state, the highest integer of the predetermined sequence might be 36, whereas in the lottery game of another state, the highest integer of the sequence may be 47. The player is typically required to pick 5 or 6 different integers from the predetermined sequence of integers depending upon the number of integers in the sequence.

The selection of the 6 integers by the patron is often a problem and may include superstitions such as choosing numbers by birthdate, house number, or even through the zodiac. To aid patrons in choosing the numbers they wish to use, states often provide some method of "quick pick" wherein the computer automatically, and randomly chooses numbers for the patron. In so providing; however, much of the mystique surrounding the art of gaming is lost, and playing the lottery becomes akin to playing slot machines. In an alternative to either the random choice by the computer, or to the implementation of superstitions, a set of dice, such as those to be described, may be employed.

Use of dice in selecting a set of lottery integers would seem to have an inherent appeal to a large segment of lottery players for a number of reasons. On the one hand, many lottery players are probably attracted by the gambling element of lotteries. These players are familiar and comfortable with using dice in other forms of gambling. On the other hand, other lottery players may be responding to the recreational element of lotteries. These players are familiar and comfortable with the use of dice in number and turn selection in many recreational games.

Different devices for assisting players in integer selection, for playing lotteries and games of chance, are known in the prior art. Some representative prior art devices are those disclosed in Lang, U.S. Pat. No. 604,401; L. P. Bott, Jr., U.S. Pat. No. 1,561,592; Dery, U.S. Pat. No. 4,678,190; Fischer, U.S. Pat. No. 4,874,175; Schiechl, U.S. Pat. No. 5,013,040; and Sanditen, U.S. Pat. No. 5,031,915. The U.S. patents to Sanditen, Freitas and Fischer disclose non cubic dice, while the U.S. patents to Lang, Bott and Dery each have cubic surface arrangement, but with different integer patterns. In all dice sets but Schiechl, each die contains more than one integer, and in the latter, each die has only one integer but these integers are not weighted statistically as to enhance the prospects of anticipating numbers actually drawn in the lottery game with each weighted subset of integers being signified by a separate color.

As the diversity of prior art dice sets of the above identified patents demonstrate, much thought and effort has gone into creating a dice set that will accomplish the dual objective of permitting the player to have fun while, at the same time, objectively selecting a set of lottery integers or numbers. However, there has been little effort to provide a set of dice that provide a random selection of integers from the predetermined sequence while simultaneously providing a statistically weighted method of choosing numbers more likely to appear. Moreover, the prior art dice sets are overly complex in appearance, and too expensive to fabricate in such a manner as to assure perfect symmetry. Lastly, these dice sets often require multiple rolls to pick the final set of integers as in Schiechl, U.S. Pat. No. 5,013,040.

SUMMARY OF THE INVENTION

Objectives of the invention include providing an improved method and apparatus for choosing a set of integers from a predetermined sequence of numbers, which apparatus enables the user to select a predetermined set of integers from the larger sequence of numbers, in a single cast of the die.

Another object of the present invention is to provide a set of dice as above which randomly selects integers, and then assign statistical weights to each integer in accord with each integers likelihood of being chosen such that the prospects of anticipating the actual numbers drawn, are enhanced.

It is a further object of the present invention to provide a set of dice wherein each statistically weighted integer is assigned one of a preselected multiple of colors, such that the color on a given die is associated with the integer transcribed thereon and will reflect to the user the frequency that the integer was actually chosen in a prior number of lottery drawings.

It is still a further object of the present invention to provide methods and apparatus for selecting numbers anticipated to be drawn in a lottery game, whereby a players individual deliberation is avoided and dependence upon the player himself or herself is reduced.

These and other objects and advantages of the invention are obtained by the improved dice set for randomly selecting a predetermined set of numbers from a larger sequence of integers comprising a multiplicity of dice equal in number to said predetermined sequence; each of said die having a plurality of exterior surfaces; each of said die being symmetrical from one exterior surface to the next permitting the die when rolled on a flat surface, to have an equal opportunity to rest on any of said exterior surfaces; one of said exterior surfaces of each of said die having an integer transcribed thereon; and at least some portion of each of said dice having one of a preselected multiplicity of colors thereon.

These objectives and advantages are further obtained by the improved method of the present invention, the general nature of which may be stated as including a method of selecting a set of integers from a larger, predetermined sequence of integers, comprising the steps of providing a multiplicity of dice equal in number to the number of integers in said predetermined sequence with each die having a plurality of exterior surfaces with an integer of said predetermined sequence on only one surface of each die, and at least a portion of said one surface having one of a predetermined set of colors such that each color is associated with a subset of integers from said predetermined sequence of integers, such that each subset is generated by reviewing the number of times each integer was chosen in the previous years lottery with those integers appearing most often having a first color, those integers appearing next most often having a second color, until finally the integer appearing least often is assigned a color, the color appearing on the surface of the dice being the color associated with the subset of which the facing integer is a member; shaking said multiplicity of dice; rolling said multiplicity of dice onto a surface; and selecting a number of dice equal in number to said set of integers from all of said dice with the integer bearing surface oriented in the preselected position by choosing those integers having the first priority color and completing the set with each subsequent priority color until the entire set is completed.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

FIG. 3 is an exemplary table showing the number of times each integer was chosen in a given state's lottery over the past year and how colors are assigned to statistically weight said integers.

Similar numerals refer to similar parts throughout the drawings.

DESCRIPTION OF THE PREFERRED EMBODIMENT

Figure 1:
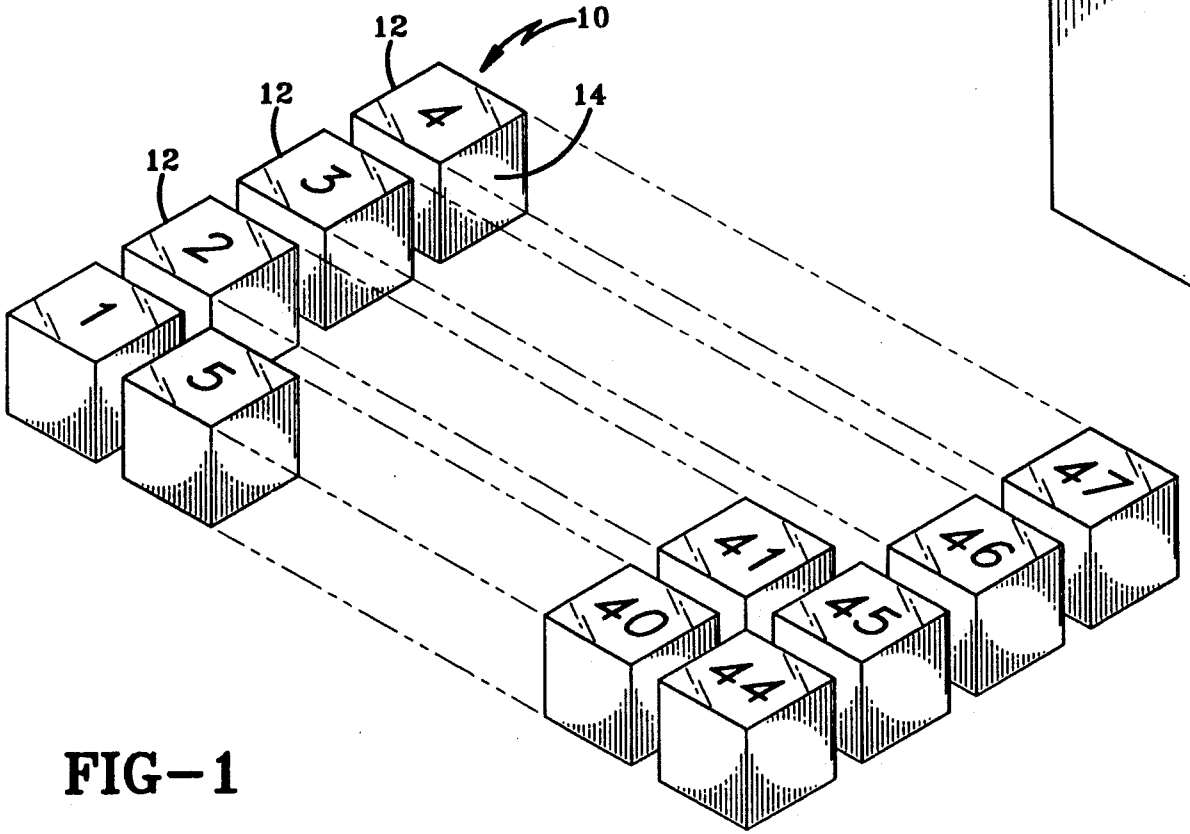
FIG. 1 is a perspective view of a dice set in accordance with the present invention.

Referring to the drawings, and particularly to FIG. 1, there is pictured a dice set, generally designated by the numeral 10, constructed in accordance with the present invention for use in selecting a set of integers from a predetermined sequence of integers. In one application of the present invention, the dice set 10 is used to select a set of integers of a preset number, for example six (6), for playing a conventional lottery game wherein integers will be drawn from a predetermined maximum sequence of different integers, for example forty-seven (47), with numbers ranging from the integer One (1) to the integer forty-seven (47), as prescribed by the lottery game rules. The integers which are randomly chosen to constitute a winning set are different from one another and are a preset number fewer than the number of integers in the predetermined sequence. The dice set 10 is composed of a multiplicity of dice 12 equal in number to the number of integers of the predetermined sequence.

Figure 2:
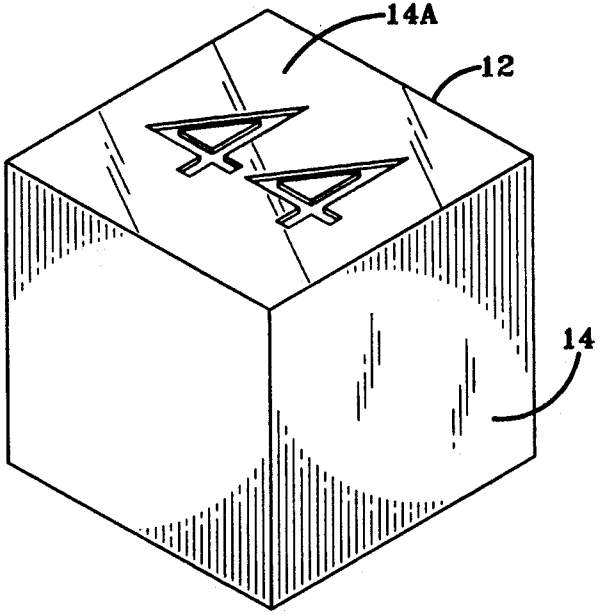
FIG. 2 is an enlarged elevational view of a single die from the dice set of FIG. 1.

Referring then to FIG. 2, each dice 12 is of a standard six sided cubic configuration having six exterior surfaces 14. Only one exterior surface 14A, of each die 12, has an integer of the predetermined sequence on it. The other exterior surfaces 14 of the die 12 are free of integers and are preferably blank. As can be readily understood from FIG. 1 and 4, each die 12 is identical to one another and the exterior shape of each die 12 is symmetrical from one exterior surface to the next about the center of the die 12, permitting die 12 when rolled on a flat surface to have equal probability of coming to rest on any of its exterior surfaces 14.

Referring still to FIG. 2, each dice has six interconnected surfaces creating a cubic shape and may be formed from any convenient material, such as aluminum, or preferably, a thermosetting plastic. Referring then to surface 14A in FIG. 2, the integer appearing thereon is preferably milled into die surface 14A of die 12. However, the integer could also be placed thereon by affixing a wear resistant decal, or by painting the integer thereon, without departing from the spirit of the present invention. Each die 12 will also have a portion of surface 14A colored with one of a preselected number of colors. Preferably the only area colored will be the surface area within the milled integer which will retard the wearing away of the paint from the die. However, it should be apparent to one skilled in the art that any colorization variations are possible such as coloring the entire die, or only the top surface, or applying a colored decal to the die. In any event, each die has an integer and color on one surface 14A. As should also be apparent to one skilled in the art, the colors chosen to represent a given set of integers have no affect on the present invention and may be chosen at random.

Referring then to FIG. 3, there is shown a table depicting the number of times a given integer was actually chosen in a state lottery drawing over a one year period. The numbers appearing thereon have been chosen randomly for purposes of this example. However, it is apparent as will be discussed herein below, that some integers have been chosen more often than others to remain representative of the actual integers chosen in the state lottery drawing. Referring then to column 2, there is listed the number of times each integer from the preselected sequence of integers was actually chosen in the state lottery drawing throughout the previous year. In column 1, there is seen the integers, from the preselected group of integers 1 to 47 listed in order, with the one that was chosen most often in the lottery drawing listed first, and the one chosen least often listed last. The integers are then divided into a convenient number of subsets, eight subsets are shown in FIG. 3, such that the first subset represents those integers chosen most often, and the eighth subset represents those integers chosen least often in the lottery drawing. As should be apparent to one skilled in the art, the number of subsets may be increased or decreased without departing from the spirit of the present invention. Often the number of subsets will vary depending on the statistical distribution of the frequency each integer was chosen in the previous years lottery. If the distribution is over a relatively tight bell curve, then the number of subsets will decrease. Conversely, if the distribution is very wide, a greater number may be required.

Continuing then, each subset is assigned a color, represented by color 1 through color 8 in FIG. 3. The color assigned to each subset is then placed on every die bearing an integer from that subset. In this manner when a given die randomly surfaces upward after any given toss of the dice, the color associated with that integer will signify that particular integers position on FIG. 3 thereby informing the user whether this number was more or less likely to be drawn during the previous years lottery drawings. In this manner, the integers are chosen randomly with the initial cast of the dice, then, once thrown, the user will choose only those dice showing integers surface up which bear the first color representing the first subset. Upon a finding that there are no remaining dice with surface 14A bearing an integer oriented upwards, having the first color representative of the first subset, the dice showing integers of the subset represented by color 2, with integers appearing next most often in the previous years lottery will be chosen. This process will be repeated until the number of integers needed to complete the predetermined set is met, in our example the number is six. The primary application envisioned for the above determined dice set 10 is to assist a lottery player in selecting the small set of integers for playing the lottery game from the larger predetermined sequence of different integers prescribed by the lottery game rules in a single throw of the dice.

In a method of selecting the predetermined set of integers for playing the lottery, the player first shakes the multiplicity of dice 12 in his or her cupped hands, or in a cup, and then rolls the dice onto a flat surface such as a table or desk. The dice 12 are rolled only once as long as at least the number of dice have integers facing upward equals at least the number of integers required to be selected, as determined by the lottery rules. In nearly all instances at least six out of forty-seven dice will land with surface 14A facing upward on a single throw of dice set 10 thereby eliminating the need to repeatedly roll the dice until six dice are oriented with integers facing upward. Once thrown, the user will assure himself that the number of dice thrown with integers facing upward is equal to or greater than the preset number of integers in the set selected for playing the particular lottery game. The user then will choose only those dice having surface 14A upwardly oriented from the first color representing subset one, for example, gold. Once all the dice having surface 14A upwardly oriented from the first color gold have been chosen, those dice bearing the second color, for example, silver, representative of the second subset having surface 14A upwardly oriented will be chosen. This process is repeated until the number of dice chosen is equal to the present number of integers in the set selected for playing the particular lottery game.

Figure 4:
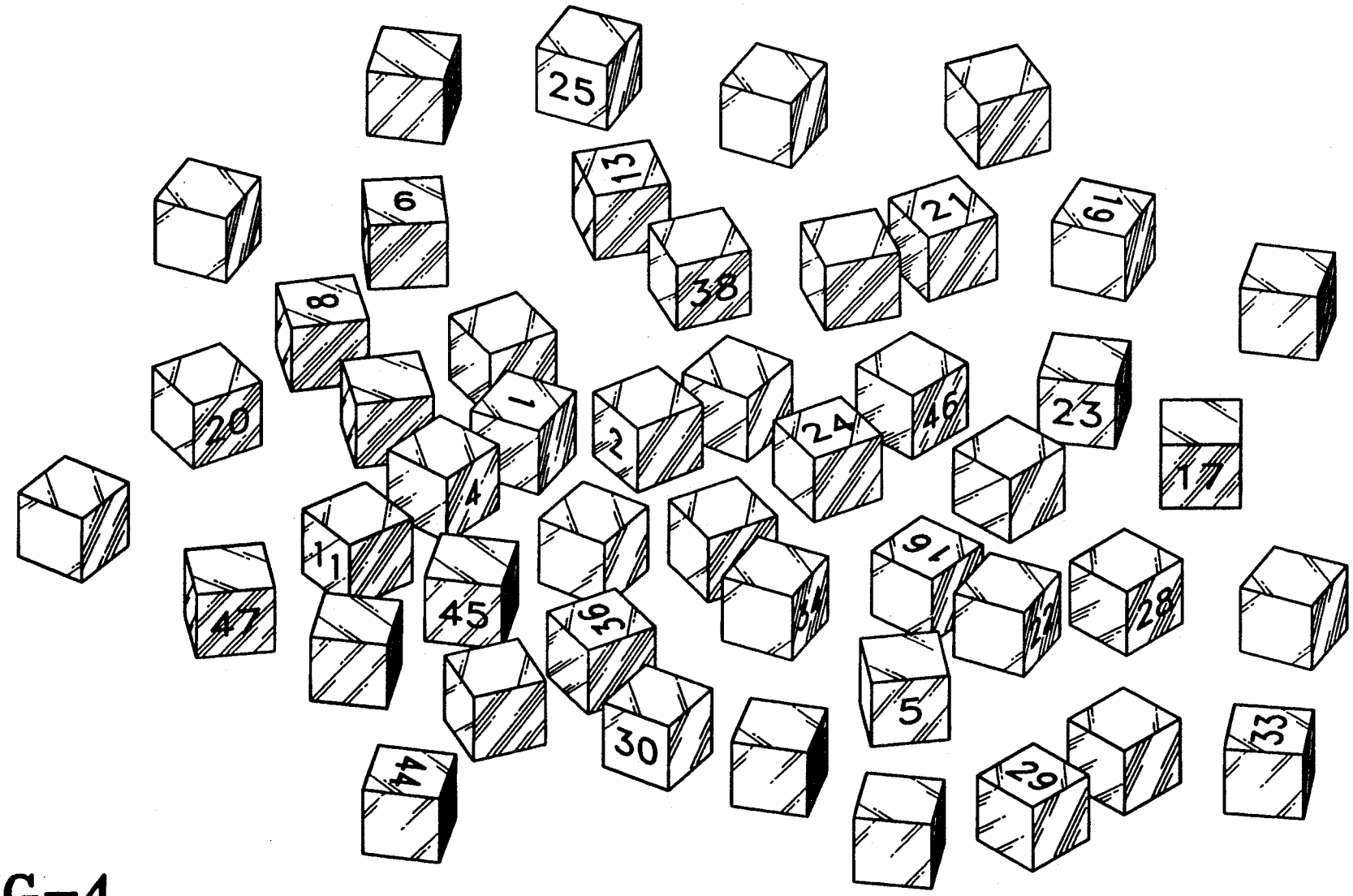
FIG. 4 is a perspective view of a random throw of the complete dice set showing both blank surfaces as well as colored and integer surfaces facing upward.

Referring next to FIG. 4, there is seen a random throw of the dice set of the present invention. Assumed then, by way of example, that FIG. 3 represents the statistical distribution of numbers employed in the creation of the dice set of the random throw of FIG. 4. In FIG. 4, there is seen forty-seven dice of a random throw wherein each die has an integer of the predetermined sequence of integers one to forty-seven thereon. Numbers one, six, eight, thirteen, sixteen, nineteen, twenty one, twenty four, twenty nine, thirty six and thirty three are oriented in the preselected upward orientation, which group of eleven numbers contain the numbers to be included in the predetermined set of six numbers to be chosen or "played" from the larger predetermined sequence of integers one to forty seven.

Each surface 14A of each die would further bear the color associated with the subset that the integer appearing thereon is a member. For example, and referring to FIG. 3, the die bearing the integer 1 would have upon surface 14A the color gold as indicated in FIG. 3. Moreover, the die bearing the integer 6 would bear the color represented by color three, for example, green. The die bearing the integer 8 would bear the color represented by color seven, for example, red. Deciding which of those dice having surface 14A oriented in the preselected orientation would be included in the first integer set is accomplished in the following way. Those dice with integers appearing thereon chosen most often, and therefore represented by the color gold one will be chosen first. Therefore, only that die bearing the integer 1 is chosen first as only that die has the color gold on surface 14A oriented upward. Continuing then, those dice which are a member of subset 2 and are therefore represented by the color silver will be chosen next. As is apparent, only that die bearing integer 36 would have the color silver, and would therefore be chosen next. The user would then look for any die bearing the color green, and would then choose dice 6 and 21. Next, any dice bearing the color represented by color four, for example blue, with surface 14A oriented upward will be chosen. Only that die bearing the integer 19 would bear this color blue as only that integer falls within the fourth subset. As only one more integer is needed to complete a preselected set of numbers, the final integer will be chosen from those dice bearing the color red of the fifth color set, in this particular toss that number is 16. As can be seen then, no dice need be drawn from color six, color seven or color eight as the full set of dice necessary to complete the predetermined set of six numbers was met choosing dice from only the first five colors. Moreover, it often is the situation that a given color will have no representative dice in the correct orientation. In this situation, the preselected set of dice will simply have no dice bearing that color.

In summary, it can be readily understood that in using the dice set 10 described above to select lottery numbers, there is present the same elements of luck, random choosing, and gambling that the lottery game has in itself. However, also present are means to provide methods for enhancing the prospects of anticipating numbers to be actually drawn in lottery games. As should be readily understood to one skilled in the art, the subsets could be chosen and colors assigned, in reverse order such that those integers chosen least often in the previous year represented by color 8 in column three on FIG. 3, will be chosen first by the user rather than last. In this way, a statistical average will result over a number of years.

Accordingly, the dice set is simplified, provides an effective, safe, inexpensive, and efficient device which achieves all the enumerated objectives, provides for eliminating difficulties encountered with prior dice sets, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved dice set and method for choosing numbers from a preselected sequence of numbers is constructed and used, the characteristics of the construction, and the advantageous, new and useful results obtained; the new and useful structures, devices, elements, arrangements, parts and combinations, and method steps are set forth in the appended claims.

I claim:

1. Apparatus for randomly selecting a predetermined set of numbers from a larger sequence of integers comprising:

a multiplicity of dice equal in number to said predetermined sequence;

each of said die having a plurality of exterior surfaces;

each of said die being symmetrical from one exterior surface to the next permitting the die when rolled on a flat surface, to have an equal opportunity to rest on any of said exterior surfaces;

one of said exterior surfaces of each of said die having an integer transcribed thereon; and at least some portion of each of said dice having one of a preselected multiplicity of colors thereon, each color in said multiplicity of colors being associated with a subset of integers such that each subset is generated by reviewing the number of times each integer was chosen in the previous years lottery, with the numbers appearing most often having a first color, numbers appearing next most often having a second color, until finally the number appearing least often is assigned a color.

2. An apparatus as defined in claim 1 wherein only the exterior surface bearing the integer is of one of the preselected multiplicity of colors.

3. An apparatus as defined in claim 1 wherein the surface area covered by the integer itself is of one of a preselected multiplicity of colors.

4. An apparatus as defined in claim 1 wherein each die is cubic in configuration.

5. An apparatus as defined in claim 1 wherein the integer is recessed into the exterior surface of the dice; and in which one of said colors is applied within said integer recess.

6. A method of selecting a set of integers from a larger, predetermined sequence of integers, comprising the steps of:

providing a multiplicity of dice equal in number to the number of integers in said predetermined sequence with each die having a plurality of exterior surfaces with an integer of said predetermined sequence on only one surface of each die, and at least a portion of said one surface having one of a predetermined set of colors such that each color is associated with a subset of integers from said predetermined sequence of integers, such that each subset is generated by reviewing the number of times each integer was chosen in the previous years lottery with those integers appearing most often having a first color, those integers appearing next most often having a second color, until finally the integer appearing least often is assigned a color, the color appearing on the surface of the dice being the color associated with the subset of which the facing integer is a member;

shaking said multiplicity of dice;

rolling said multiplicity of dice onto a surface;

selecting a number of dice equal in number to said set of integers from all of said dice with the integer bearing surface oriented in the preselected position by choosing those integers having the first priority color and completing the set with each subsequent priority color until the entire set is completed.

7. The method of claim 6 wherein said preselected set of integers is six.

8. The method of claim 6 wherein the subset of numbers represented by the first priority color are the numbers appearing least often in the prior preselected time period lottery, and the lowest priority color representing the integers chosen most often in the prior preselected time period actual lottery drawings.

9. The method of claim 6 wherein the subset of numbers represented by the first priority color are numbers appearing most often in the prior preselected time period lottery, and the lowest priority color representing the integers chosen least often in the prior preselected time period actual lottery drawings.

10. A method of selecting a set of integers from a larger, predetermined sequence of integers by the roll of a multiplicity of dice, wherein each of said dice has a different one of the integers identified on only one integer bearing surface of said die, including the steps of:

determining the number of times each integer of the sequence was randomly selected during a predetermined time period;

grouping a plurality of integers into a plurality of subsets according to said determination of times selected;

prioritizing the subsets according to said determination of times selected;

placing an indicating indicia on each die of each of the subsets in order to identify the dice of each subset;

rolling the multiplicity of dice into a surface; and selecting the desired set of integers from all of said dice having the integer bearing surface oriented in a preselected position by the priority of the subsets in which the integers are contained.

11. The method defined in claim 10 in which the indicating indicia is a color.

12. The method defined in claim 10 in which the priority of the subsets are in descending order from the most frequently selected integers to the least frequently selected integers.

13. The method defined in claim 10 in which the priority of the subsets are in ascending order from the most frequently selected integers to the least frequently selected integers.

* * * * *